US008110098B2

(12) United States Patent
Hui

(10) Patent No.: US 8,110,098 B2
(45) Date of Patent: Feb. 7, 2012

(54) POOL CLEANING VEHICLE WITH FILTER ELEMENT AND SELF LOCKING CLIP

(75) Inventor: Wing-kin Hui, Hong Kong (HK)

(73) Assignee: Pool Bag Limited, Hong Kong (HK)

( * ) Notice: Subject to any disclaimer, the term of this patent is extended or adjusted under 35 U.S.C. 154(b) by 308 days.

(21) Appl. No.: 12/272,879

(22) Filed: Nov. 18, 2008

(65) Prior Publication Data

US 2010/0122948 A1 May 20, 2010

(51) Int. Cl.
*E04H 4/16* (2006.01)

(52) U.S. Cl. ..... 210/167.16; 210/232; 15/1.7

(58) Field of Classification Search ..... 210/167.16, 210/167.17, 232; 15/1.7
See application file for complete search history.

(56) References Cited

U.S. PATENT DOCUMENTS 4,168,557 A * 9/1979 Rasch et al. ..... 15/1.7
4,575,423 A * 3/1986 Alanis et al. ..... 210/167.17
5,611,922 A * 3/1997 Stene ..... 210/238
5,842,243 A * 12/1998 Horvath et al. ..... 15/1.7
6,627,074 B2 * 9/2003 Lincke ..... 210/167.17
6,971,136 B2 * 12/2005 Horvath et al. ..... 15/1.7

FOREIGN PATENT DOCUMENTS

CN 1244746 C 3/2006
EP 1947265 A2 7/2008

* cited by examiner

*Primary Examiner* — Fred Prince
(74) *Attorney, Agent, or Firm* — Peninsula IP Group; Douglas A. Chaikin

(57) ABSTRACT

Disclosed herein is an improved pool cleaning vehicle. The vehicle includes a housing, a bottom frame and a filter bag between the housing the bottom frame and attached to the bottom frame. The vehicle includes an intake and an outlet, both of which are in communication with the filter bag. The housing is releaseably attached to the bottom frame and the filter bag releaseably connected to the bottom frame. A V-shaped self locking clip with normally outwardly extending legs serves as the attachment member and when urged toward each other with the housing in the locked position allows for easy release. At least one of the intake or outlet includes a filter member. The filter member includes a means for attachment and a particulate filter member for filtering particulates from the water. The filter member is attached to the vehicle at or proximate to the perimeter of the intake or outlet.

16 Claims, 4 Drawing Sheets

POOL CLEANING VEHICLE WITH FILTER ELEMENT AND SELF LOCKING CLIP

FIELD OF THE INVENTION

This invention generally relates to the field of pool products. More particularly, this invention relates to a swimming pool vehicle, which includes a filter member for filtering particulates at the intake and outlet ports of the vehicle.

BACKGROUND OF THE INVENTION

It is now well accepted that pool cleaning devices, such as pool cleaning vehicles are essential to the proper maintenance of a pool, whether the pool be above or below ground. The typical vehicle includes a housing, a bottom frame and a filtering member held between the two. The vehicle includes intake and outlet ports. Typically, the ports are in the form of a free swinging door.

As the pool cleaner moves along the surface of the pool water flows into the intake port and through to the filter bag. The typical pool cleaning vehicle includes a pump which creates suction. The suction helps cause the door to open and allow water to flow therethrough as the vehicle moves.

Upon entering the filter bag, dirt and debris is trapped therein. Water then exits through the outlet port, cleaner and with less dirt and debris prior to re-entering the pool.

After its cleaning is complete, the vehicle is lifted from the pool. Water trapped in the vehicle then drains back into the pool. In the typical case, where the ports include free-swinging doors, dirt and debris trapped in the housing simply flows back into the pool without the benefit of being cleaned. A substantial portion of the work done during the cleaning operation is thus lost as dirt and debris re-enter the pool.

In order to remedy this issue, others have used a spring loaded door for the ports instead of a free-swinging door. (U.S. Pat. No. 7,213,287). While theoretically this works and in practice, it is partially successful, limitations of the vehicle cause a less than satisfactory result in many cases. For example, the door cannot close fully because of imperfection in the fit of the door to the vehicle. Additionally, there are almost always thermal distortions in the plastic from which the typical vehicle housing and bottom frame are made. This means that upon removal of the vehicle from the water, dirt and debris will leak out of the filter bag because, even in the spring loaded version of the port, the closed position of the door does not provide a fluid tight seal. Thus, dirt and debris that was in the filter bag may well end up back in the pool, or at least a substantial portion thereof.

In virtually all cases involving a swinging door, whether or not spring loaded, fine dirt will find a way to leak through the ports. It is inherent that the door swing freely to operate properly as a vent. The door needs to swing so as not to cause a pressure drop (At least a partial vacuum is created to draw dirt and debris into the filter bag.) or to close too much, so as to block or obstruct dirt and debris from entering the filter bag through the intake port. Thus, it would be inherently unlikely for the door to both open enough to allow dirt and debris to enter the intake port, but not so much as to cause a pressure drop in the interior of the housing during vacuuming of the pool.

In another aspect of the pool cleaning device, and more specifically, the pool cleaning vehicle, when the vehicle is lifted out of the pool and after the water drains from the vehicle, the filter bag is removed from vehicle. In current and past devices, removing the filter bag is a chore. In a typical application, the bottom frame includes a slider latch with ridges and the housing includes a loop. The top portion of the slider may include ridges in some embodiments and as the latch slides against the loop addition friction is created to cause the filter bag to remain in place.

As will be appreciated, it is often difficult to get at the latch and especially when the vehicle is wet, the latch and housing with be slippery making the removal and replacement of the filter bag increasingly difficult.

What is needed is a pool cleaning device, which upon removal of the device from the pool, prevents substantially all of the dirt and debris from draining back or re-entering the pool. Additionally, a rapid release locking system for easy removal and replacement of the filter bag is also needed.

SUMMARY OF THE INVENTION

The structure, in accordance with the present invention, is a pool cleaning vehicle, having a filter element on at least the intake or outlet ports of the device. The device is in the form of a vehicle, which moves around the pool surface when the pool is filled with water. A pump creates at least a partial vacuum in the interior of the housing for facilitating the removal of dirt and debris from the pool. Such dirt and debris is sucked into the interior of vehicle and trapped in the filter bag, preventing its return to the pool. The filter bag is located in the interior of the housing communicating with the intake port and outlet ports. The ports are typically found in the bottom frame, but may also be found on the housing. The filter element being proximate the ports filters and prevents re-entry of dirt and debris from the filter bag as the vehicle is pulled from the water and as water drains back into the pool.

In order to facilitate efficient removal and replacement of the filter bag, a self locking clip is provided for attaching the filter bag and bottom frame to the housing.

Thus, It is an object of this invention is to provide a pool cleaning vehicle having the ability to filter dirt and debris at the intake and outlet ports of the vehicle.

It is an additional object of this invention to provide such a pool cleaning vehicle, which minimizes the amount of debris and dirt, which re-enters a pool upon removal of the vehicle from the pool water.

It is an additional object of this invention to provide such a pool cleaning vehicle, which includes a self locking releasable clip for ease and efficiency in removal and replacement of the filter bag.

In accordance with the objects set forth above and as will be described more fully below, the pool cleaning vehicle in accordance with this invention, comprises:

the vehicle having a water inlet port in communication with the filter bag and a water outlet port also in communication with the filter bag;

at least one of the inlet or outlet ports having a perimeter; and a port filter member including a means for attachment to an area adjacent the port and a particulate filter means for filtering particulates from the water, the particulate filter means proximate the perimeter of at least one of the inlet or outlet ports; and whereby, particulates are trapped by the filter member at least at one of either the inlet or outlet ports and prior to re-entering the pool water.

In another exemplary embodiment of the pool cleaning vehicle in accordance with this invention, each of the ports includes a baleen filter member proximate the perimeter of each of the ports.

In another exemplary embodiment of the pool cleaning vehicle in accordance with this invention, the ports define free-swinging vent doors in the bottom frame and there exists a gap around the perimeter of each the vent doors and the baleen filter surrounds and is in close proximity to the gap.

In another exemplary embodiment of the pool cleaning vehicle in accordance with this invention, the baleen filter member is connected to the vent door through mechanical means, namely through the use of Velcro hooks and loops.

In another exemplary embodiment of the pool cleaning vehicle in accordance with this invention, the baleen filter member is connected to the bottom frame around the perimeter of the vent door instead of the vent door itself.

In yet another exemplary embodiment of the pool cleaning vehicle in accordance with this invention, the pool cleaning vehicle including a housing, a bottom frame and a filter bag between the housing the bottom frame and attached to the bottom frame, the pool cleaning vehicle, comprises:

the vehicle have a water inlet in communication with the filter bag and a water outlet also in communication with the filter bag;

the housing releaseably attached to the bottom frame and the filter bag releasably connected to the bottom frame;

at least one of the water inlet or the water outlet includes a filter member, the filter member including a means for attachment and particulate filter means for filtering particulates from the water;

the filter member being attached to the vehicle at or proximate to the perimeter of the inlet and outlet;

the bottom frame including releasable connection means for connecting the filter bag and the bottom frame; the releasable connection means comprising a self locking clip, which is normally outwardly urged and which upon engagement by the housing is urged into a closed position for locking the housing and bottom frame and filter bag in connection with one another.

In a specific exemplary embodiment of the pool cleaning vehicle in accordance with this invention, the bottom frame and the housing trap a filter bag which is held to the bottom frame and locking the housing and frame and filter bag together by a releasable clip, the clip comprising:

an attachment member having a first leg and a second leg, the legs being normally urged apart;

the bottom frame having an attachment seat for connection with one of the legs; and the housing sized and shaped to interlock with the other leg for secure connection to the bottom frame.

It is an advantage of the pool cleaning vehicle in accordance with this invention to minimize the amount of dirt and debris returning to the pool water after being filtered and while the vehicle is being pulled from the pool with water draining therefrom.

It is an additional advantage of the instant invention to provide such a vehicle, which includes a means for easy and efficient release of the filter bag from the housing and bottom frame.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
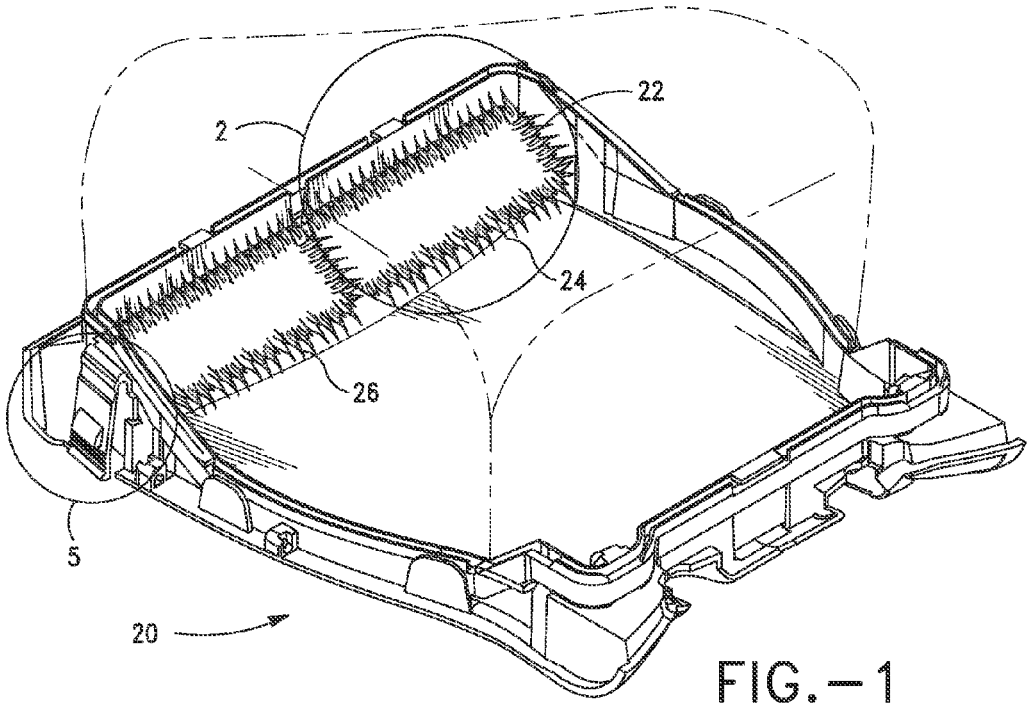
FIG. 1 is a perspective view of the bottom frame.
Figure 2:
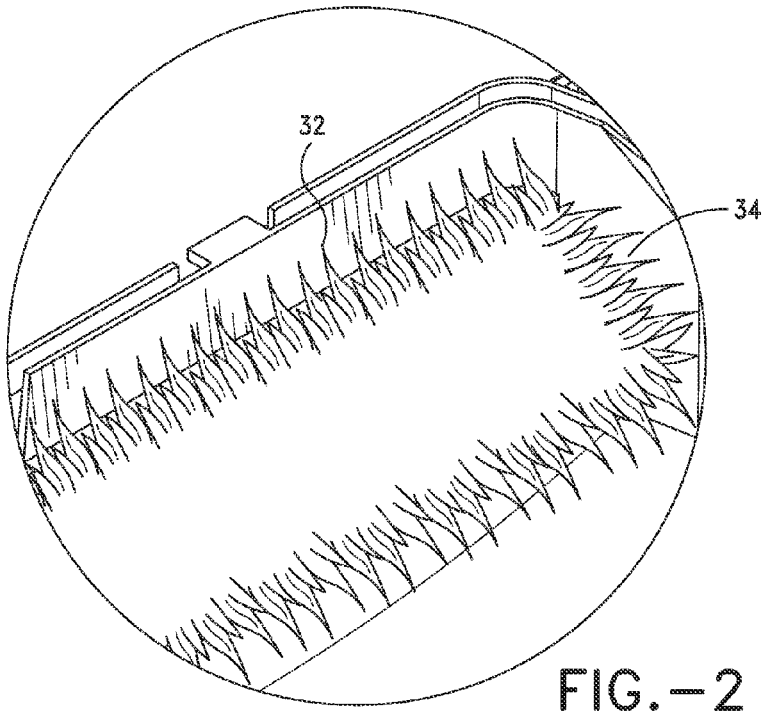
FIG. 2 is an enlarged perspective view of the bottom frame based on the circle 2 of FIG. 1.

An exemplary embodiment of the bottom frame of a pool cleaning vehicle in accordance with this invention is shown in FIGS. 1 & 2. As illustrated, the bottom frame is generally denoted by the numeral 20.

While the pool cleaning vehicle is not, itself depicted in full in the drawing, there are many examples of the same in the art. Specifically, applicant's own disclosure, U.S. patent application Ser. No. 12/100,414;, Filing Date, Apr. 10, 2008 for *A Pool Cleaning Vehicle Having Improved Intake Port* (JHUII1925) is incorporated herein and the specification and drawing of which is specifically incorporated into the specification herein. All references to the entire pool cleaning vehicle will be a reference to the pool cleaning vehicle of that drawing.

The pool cleaning vehicle includes a housing (shown in Ser. No. 12/100,414), a bottom frame 20 and a filter bag (not shown) between the housing and the bottom frame. Each of the housing, bottom frame and filter bag are connected with the filter bag trapped between the bottom frame and the housing within the interior of the housing.

Figure 7:
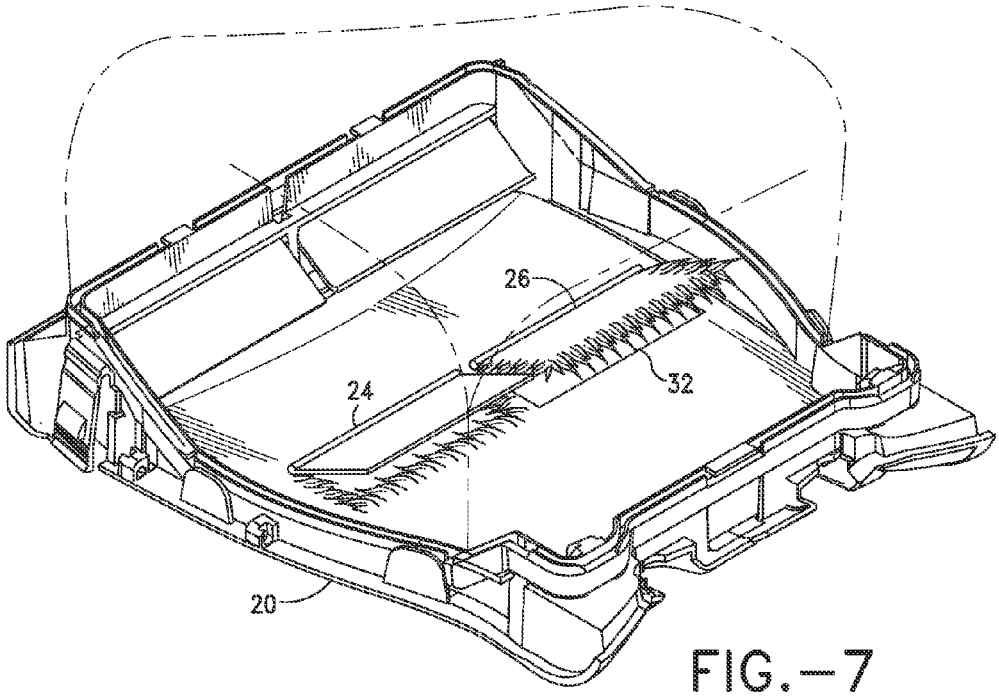
FIG. 7 is a perspective view of the bottom frame showing the outlet port having the baleen filter member.

As illustrated in FIG. 1, the bottom frame 20 includes an intake 22. In the embodiment show, the intake 22 is split into two halves, 24 and 26. Each of the halves 24 and 26 forms a vent door as shown in FIG. 7.

A filter member 30 is attached to each of the halves, 24 and 26. As will be appreciated more fully hereinafter, the filter member 30 is connected to the intake 22 through the use of Velcro. For example, the vent door on one surface includes a series of female loops and the filter member includes a series of male hooks. Together the hooks and loops form the attachment means by which the filter member is connected to the intake or outlet.

As shown in the enlarged view of FIG. 2, the filter member has a fringe around its perimeter defining a baleen filter 32. As illustrated, the baleen filter 32 includes feathering 34. The feathering 34 traps dirt and debris and thereby prevents the same from re-entering the pool water.

Figure 3:
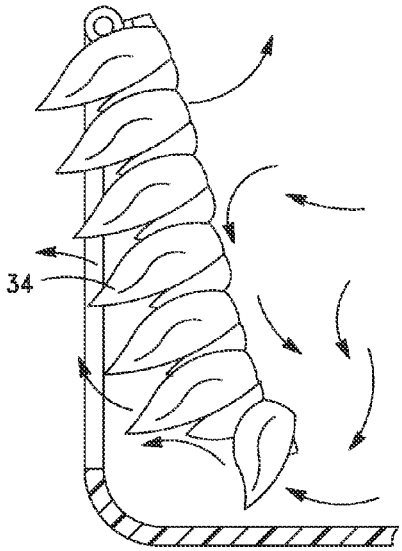
FIG. 3 is a perspective view of one port illustrating attachment of the baleen filter member with the door in the partially closed position.
Figure 4:
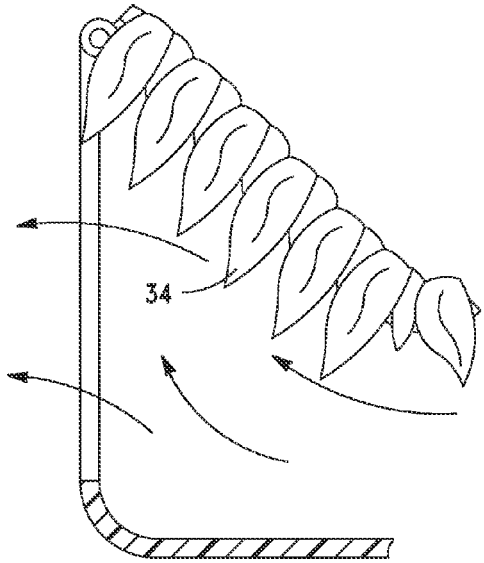
FIG. 4 is a perspective view of the port of FIG. 3 in the open position.

With respect to FIGS. 3 & 4, there is shown the vent door in the open and closed positions. FIG. 3 shows the vent door in the partially closed position. For example, as the pool cleaning vehicle is pulled out of the water, the vent door for the outlet closes partially, trapping as much of the dirt and debris as possible and yet allowing the filtered water to re-entering the pool from which it came.

FIG. 4 illustrates the vent door is the fully open position. For example, as the pool cleaning vehicle moves along the pool surface, the outlet will be in the fully open position.

In each case described and illustrated in FIGS. 3 & 4 above, the vent door is free swinging and allows water to flow freely to and from the filter bag. Additionally, regardless of position the baleen filter will trap and collect the dirt and debris and prevent it from re-entering the pool.

The baleen material is made from a non-woven polyester. However, any material that would satisfy the function of filtering particulate materials from the pool water, including dirt and debris.

Figure 5:
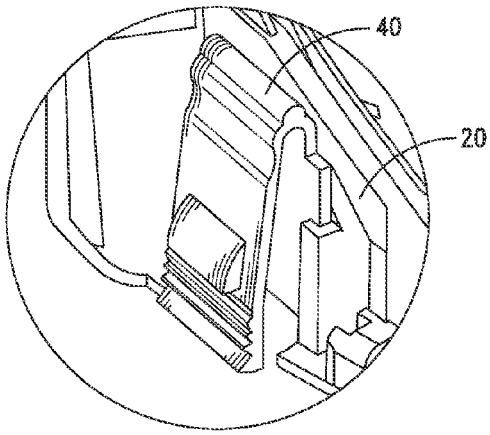
FIG. 5 is an enlarged perspective plan view of an attachment member in accordance with this invention based upon the circle in FIG. 1.
Figure 6:
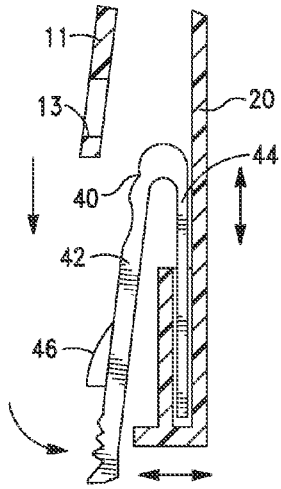
FIG. 6 is a perspective plan view of the attachment member of FIG. 5 in connection with the bottom frame and in preparation for connection to the housing.

FIGS. 5 & 6 illustrate the illustrate the member for releaseably connecting the filter bag (not shown), bottom frame 20 and housing (not shown). A clip 40 including first and second legs, 42 and 44, respectively, is used to connect the filter bag (not shown), bottom frame 20 and housing.

The two legged clipped 40 is made so that the legs are normally urged away from one another. In other words, the legs are normally urged in a spread apart condition.

The bottom frame 20 includes a seat 50 for seating the clip on the bottom frame 20. One of the legs, leg 42 includes an outwardly projecting flange 46 for interlocking the housing for a secure connection therewith.

As illustrated in FIG. 6, the housing portion generally designated by the numeral 11. The housing portion 11 has a detent 13 sized and shaped for compatible and secure locking engagement with the flange 46.

As the housing portion 11 slides over the outwardly projecting leg 42 with flange 46, the flange 46 enters the detent 13 and is securely locked thereto. As illustrated, one side of the flange forms a steep embankment. The only way for the housing to be released from the connection with the bottom frame 20 and filter bag is for the legs to be moved toward one another so that the flange 46 slides out of the detent 13. Once the flange 46 moves out of the detent 13, the housing portion 11 can slide apart from the bottom frame 20 and out of attachment with the clip 40.

FIG. 7 illustrates the baleen filter 32 around the perimeter of the outlet vent. It will be appreciated that either or both of the intake and outlet vents includes the baleen filter.

Figure 8:
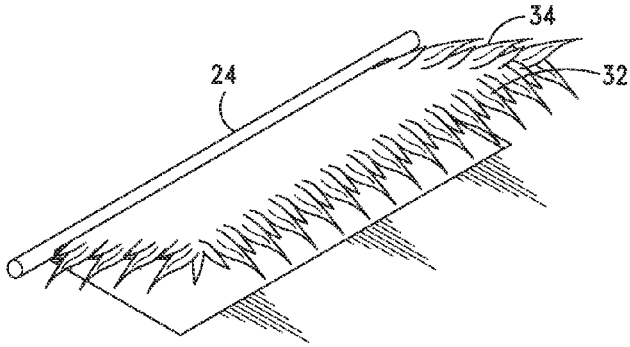
FIG. 8 illustrates the baleen filter being connected to the port.
Figure 9:
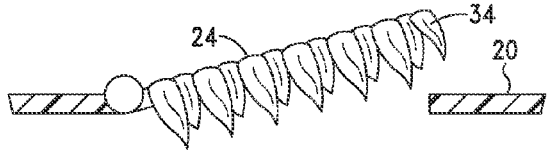
FIG. 9 is a side plan view of the baleen filter with the vent door in a partially open position.
Figure 10:
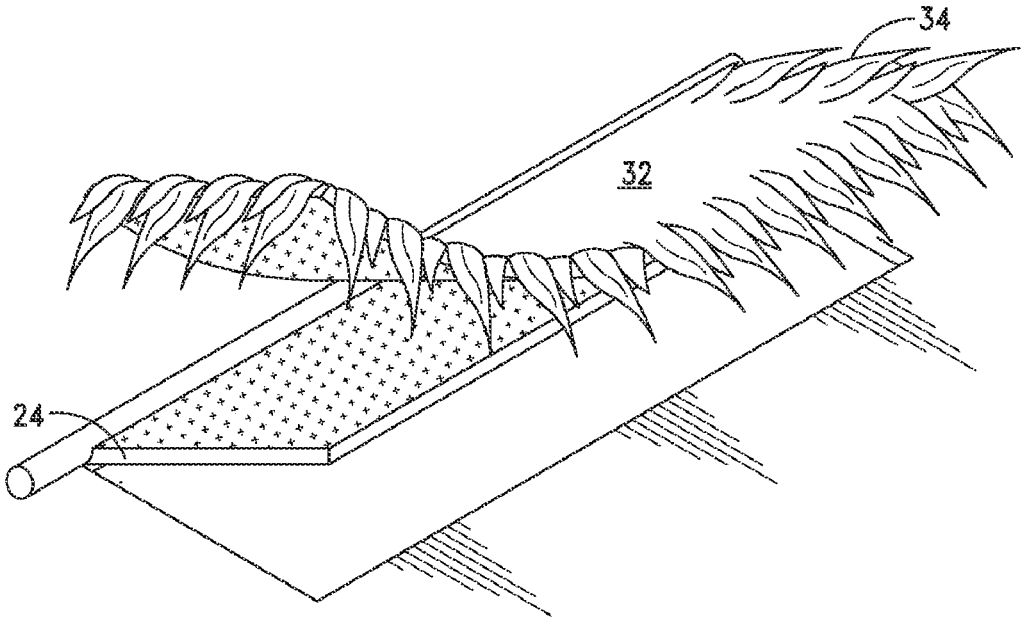
FIGS. 10 & 11 illustrates the attachment of the baleen filter to the vent door and the relationship thereto.

FIGS. 8-10 illustrate the attachment of the filter member with the vent door. As best seen in FIG. 10, the hooks of the filter member 32 are releaseably attached to the loops of the vent door half 24. As seen, the filter member 32 can, as desired, be pulled away from the vent door half 24. The filter member 32 and its baleen feathering 34 are then capable of being cleaned or replaced without the replacing the entire vehicle.

Figure 11:
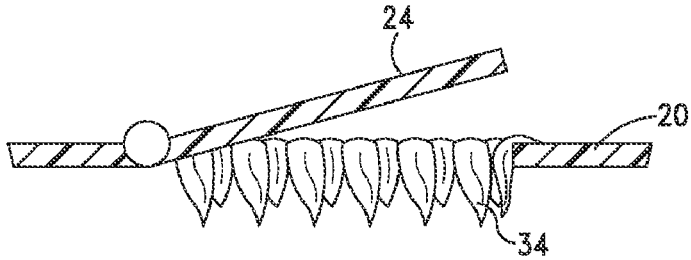

FIG. 11 shows an alternative embodiment of the attachment of the baleen filter in accordance with this invention. Here, the fringe or baleen feathering 34 is connected to the non-moving portion of the bottom frame 20 proximate the perimeter of the opening for the port. The baleen feathering 34 surrounds the perimeter of the opening of the vent door of either or both of the intake and outlet ports. Thus, in this embodiment, the free swinging vent door does not include the filter member 32.

While the foregoing detailed description has described several embodiments of the pool cleaning vehicle in accordance with this invention, it is to be understood that the above description is illustrative only and not limiting of the disclosed invention. Particularly, there are variety of different kinds of filter elements that could be attached to the vent door or surrounding opening that would prevent dirt and particulates from re-entering the water within the spirit and scope of the invention. It also will be appreciated that there are various modifications to the clip are also within the spirit and scope of the invention herein and that of particular interest is the ability of the clip to work effectively both with existing pool cleaning vehicles as well as those yet to be discovered. Thus, the invention is to be limited only by the claims as set forth below.

What is claimed is:

1. A pool cleaning vehicle including a housing, a bottom frame and a filter bag between the housing and the bottom frame, the pool cleaning vehicle, comprising:

the vehicle having a water inlet port in communication with the filter bag and a water outlet port also in communication with the filter bag;

the housing releasably attached to the bottom frame and the filter bag releaseably connected to the bottom frame;

at least one of the water inlet port or the water outlet port includes a filter member, the filter member including a means for attachment and a particulate filter means for filtering particulates from the water;

the filter member being attached to the vehicle at or proximate to the perimeter of the inlet and outlet ports;

the bottom frame including releasable connection means for connecting the filter bag and the bottom frame; the releasable connection means comprising a self locking clip, which is normally outwardly urged in an open position and which upon engagement by the housing is urged into a closed position for locking the housing and bottom in connection.

2. The pool cleaning vehicle of claim 1, wherein the filter member is proximate the perimeter of the outlet.

3. The pool cleaning vehicle of claim 1, wherein the filter member is proximate the perimeter of the inlet.

4. The pool cleaning vehicle of claim 1, wherein the filter member is proximate the perimeter of both the inlet and the outlet.

5. The pool cleaning vehicle of claim 1, wherein the inlet and outlet comprise vent doors which are free swinging.

6. The pool cleaning vehicle of claim 5, wherein there is a gap between the vent door and the vehicle, the gap defines the perimeter for each of the inlet and outlet.

7. The pool cleaning vehicle of claim 1, wherein the filter member is connected to at least one of the inlet or outlet through mechanical means.

8. The pool cleaning vehicle of claim 7, wherein the means for attachment comprises a Velcro member and wherein the particulate filter includes mating Velcro elements.

9. The pool cleaning vehicle of claim 1, wherein the particulate filter comprises a baleen filter member.

10. The pool cleaning vehicle of claim 1, wherein the filter element includes a means for attachment to the vehicle and wherein the filter element includes a fringe defining a baleen filter.

11. The pool cleaning vehicle of claim 10, wherein the filter element is attached to the vent door and the baleen filter is proximate the perimeter of the vent door.

12. The pool cleaning vehicle of claim 10, wherein the vehicle includes openings for the inlet and the outlet and the filter element is attached to the proximate to the opening with the baleen filter proximate the perimeter of the opening.

13. A pool cleaning vehicle including a housing, a bottom frame and a filter bag between the housing the bottom frame, the pool cleaning vehicle, comprising:

the vehicle having an inlet in communication with the filter bag and an outlet also in communication with the filter bag;

at least one of the inlet or outlet having a perimeter; and a filter member including a means for attachment to the vehicle and particulate filter means for filtering particulates from the water, the particulate filter means proximate the perimeter of at least one of the inlet or outlet, whereby, particulates are trapped by the filter member at least at one of either the inlet or outlet and prior to re-entering the pool water.

14. A pool cleaning vehicle including a housing, a bottom frame and a filter bag between the housing the bottom frame and attached to the bottom frame, and means for attaching the filter bag to the bottom frame, comprising:

an attachment member having a first leg and a second leg, the legs being normally urged apart;

the bottom frame having an attachment seat for connection with one of the legs; and the housing sized and shaped to interlock with the other leg for secure connection to the bottom frame.

15. The pool cleaning vehicle as set forth in claim 14, wherein the non-seated leg includes a rising member and wherein the housing has an detent for compatible connection with the rising member, such that upon interlocking connection, the rising member fits within the detent and is urged toward the leg opposed from the non-seated leg for secure locking connection of the housing and bottom frame.

16. The pool cleaning vehicle as set forth in claim 15, wherein the non-seated leg includes a gripping member for additional secure connection.

* * * * *